United States Patent [19]

Polit

[11] Patent Number: 4,462,199

[45] Date of Patent: Jul. 31, 1984

[54] ROTARY INSERTER

[75] Inventor: Neil A. Polit, Crystal Lake, Ill.

[73] Assignee: Xerox Corporation, Stamford, Conn.

[21] Appl. No.: 292,570

[22] Filed: Aug. 13, 1981

[51] Int. Cl.[3] ..... B65B 5/00

[52] U.S. Cl. ..... 53/266 A

[58] Field of Search ..... 53/266 R, 266 A, 460, 53/569, 266; 270/57

[56] References Cited

U.S. PATENT DOCUMENTS

| | | | |
|---|---|---|---|
| 1,421,835 | 7/1922 | Russ | 53/266 A |
| 1,610,965 | 12/1926 | Ranney et al. . | |
| 3,801,394 | 4/1974 | Alexander et al. | 156/70 |
| 3,858,381 | 1/1975 | Huber et al. | 53/188 |
| 3,894,905 | 7/1975 | Ehlscheid | 156/384 |

*Primary Examiner*—A. J. Heinz

*Attorney, Agent, or Firm*—Frederick E. McMullen

[57] ABSTRACT

A rotary inserter for inserting insert material into envelopes in a continuous unidirectional motion. The inserter has envelope and insert clamps supported on separate rotating arms such that envelopes and inserts carried by the envelope and insert clamps overlap at one point during rotation. Separate envelope and insert loading stations are provided whereat envelopes and inserts are supplied to the respective envelope and insert clamps.

To facilitate inserting of the insert into the envelope, vacuum assist means are provided to spread the envelope preparatory to receipt of the insert. An output conveyor is provided to withdraw the envelope bearing insert following completion of the inserting operation.

7 Claims, 8 Drawing Figures

ROTARY INSERTER

This invention relates to an inserter, and more particularly to a high speed rotary inserter and method of inserting.

Inserters serve to deposit, i.e. insert, materials such as cards, brochures, and the like into mailing pieces which typically comprise envelopes. Thereafter of course, the envelope with the inserted material is sealed, addressed, and stamped for delivery by the postal service.

Typically, the foregoing work is handled on a commercial basis by a mailing house, where, as will be readily understood, speed is an important and even critical factor in determining whether the work is profitable or not. Current inserter designs usually involve some element of reciprocating motion as for example at the point where insertion is made, and the ensuing change in direction and speed, which at high speed can be abrupt, inherently restricts inserter operating speed which in turn reduces output rate. Additionally, counterbalancing is usually required if excessive noise and vibration of the inserter are to be avoided.

One manner of alleviating the aforedescribed problems is to employ an inserter of the linear type. This inserter type is usually manifested by at least two conveyors, one for the envelopes, the other for the inserts. Here, the axes of the conveyors cross at some appropriate point in the conveyor run. Thus, inserts and envelopes are brought closer and closer together until the point where the inserts are placed in the envelopes.

One disadvantage of linear type inserters is the relatively large amount of work area taken up by these devices. This is due to the fact that the angle of intersection must be relatively small if abrupt changes in envelope and insert movement are to be avoided.

This invention relates to an inserter comprising a pair of support members; envelope clamping means on one of the support members adjacent at least one terminus thereof; insert clamping means on the other of the support members adjacent at least one terminus thereof; means supporting the members for rotation such that the envelope clamping means and the insert clamping means pass closely adjacent to one another during a portion of the arc of rotation of the members in an insert area; means to provide an envelope to the envelope clamping means at a point in the rotational arc of the member supporting the envelope clamping means remote from the insert area; means to provide at least one insert to the insert clamping means at a point in the rotational arc of the member supporting the insert clamping means remote from the insert area; means for actuating the envelope clamping means and the insert clamping means to grasp the envelope and insert provided thereto; means for rotating the support members in opposite directions so that the envelope and insert clamping means bring the envelope and insert into overlapping relation as the envelope and insert clamping means pass through the insert area; envelope spreading means to spread the envelope for receipt of the insert upstream of the insert area; means to transfer the insert from the insert clamp means following disposition of the insert in the envelope; means to inactivate the envelope spreading means to enable the envelope to close; and means to release the envelope clamping means and discharge the envelope together with the insert.

The invention further relates to a method of placing an insert into an envelope in a uniform non-reciprocating motion and without substantial vibration, the steps which comprise operating individual envelope and insert clamps to grasp an envelope and the insert to be inserted therewithin; moving the envelope and insert clamps with the envelope and insert therewithin along converging rotary paths; as the paths converge, opening the envelope clamp and spreading the envelope apart to receive the insert; closing the envelope clamp while the paths overlap to grasp the insert placed within the envelope by the envelope clamp to withdraw the insert from the insert clamp as the paths diverge; and before the paths re-converge, opening the envelope clamp to discharge the envelope together with the insert therewithin.

IN THE DRAWINGS

FIG. 1 is a schematic view showing the rotary inserter of the present invention;

FIGS. 2*a* and 2*b* are schematic views showing details of the inserter envelope clamp;

FIGS. 3*a* and 3*b* are schematic views showing details of the inserter insert clamp;

Figure 1:
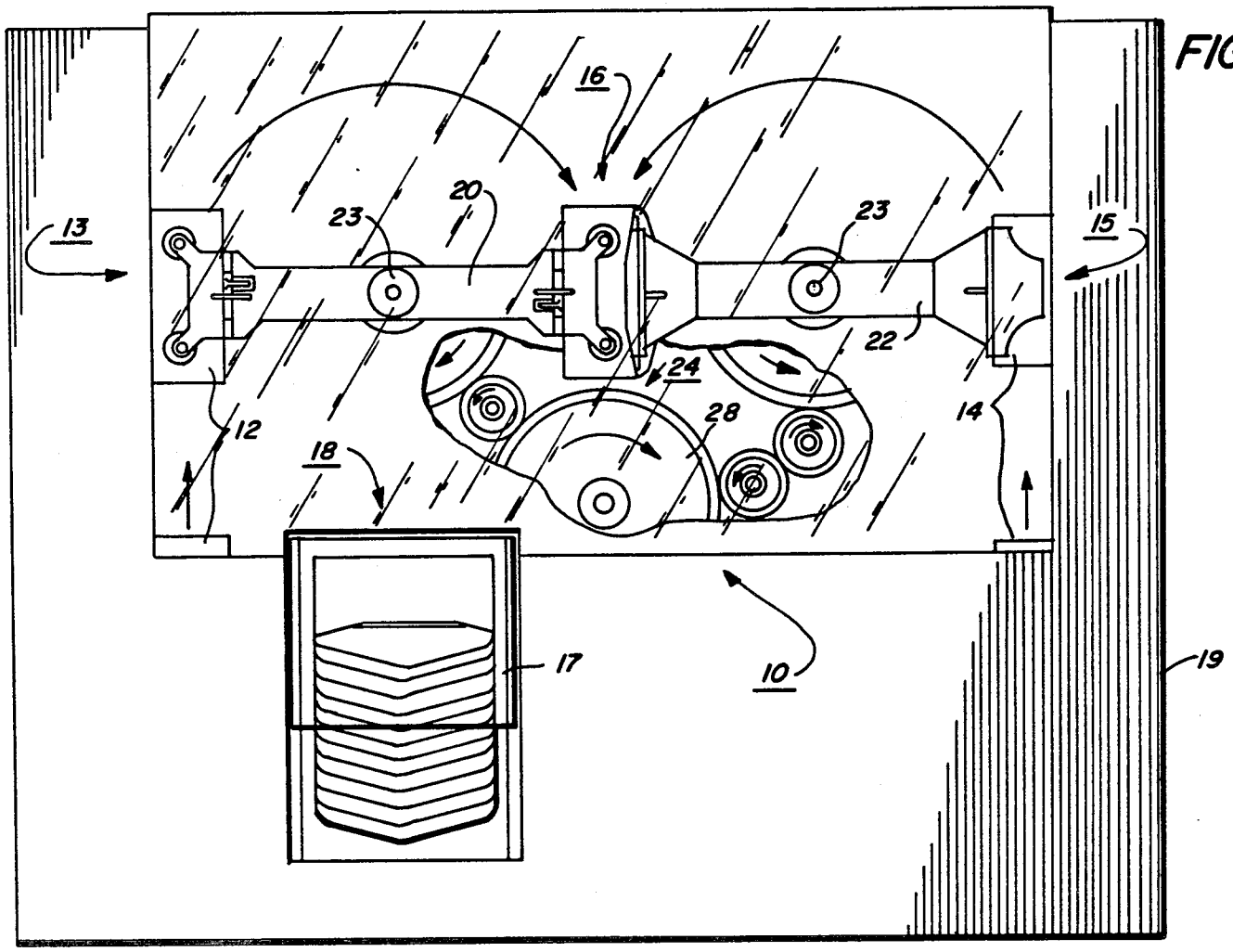
Figure 2A:
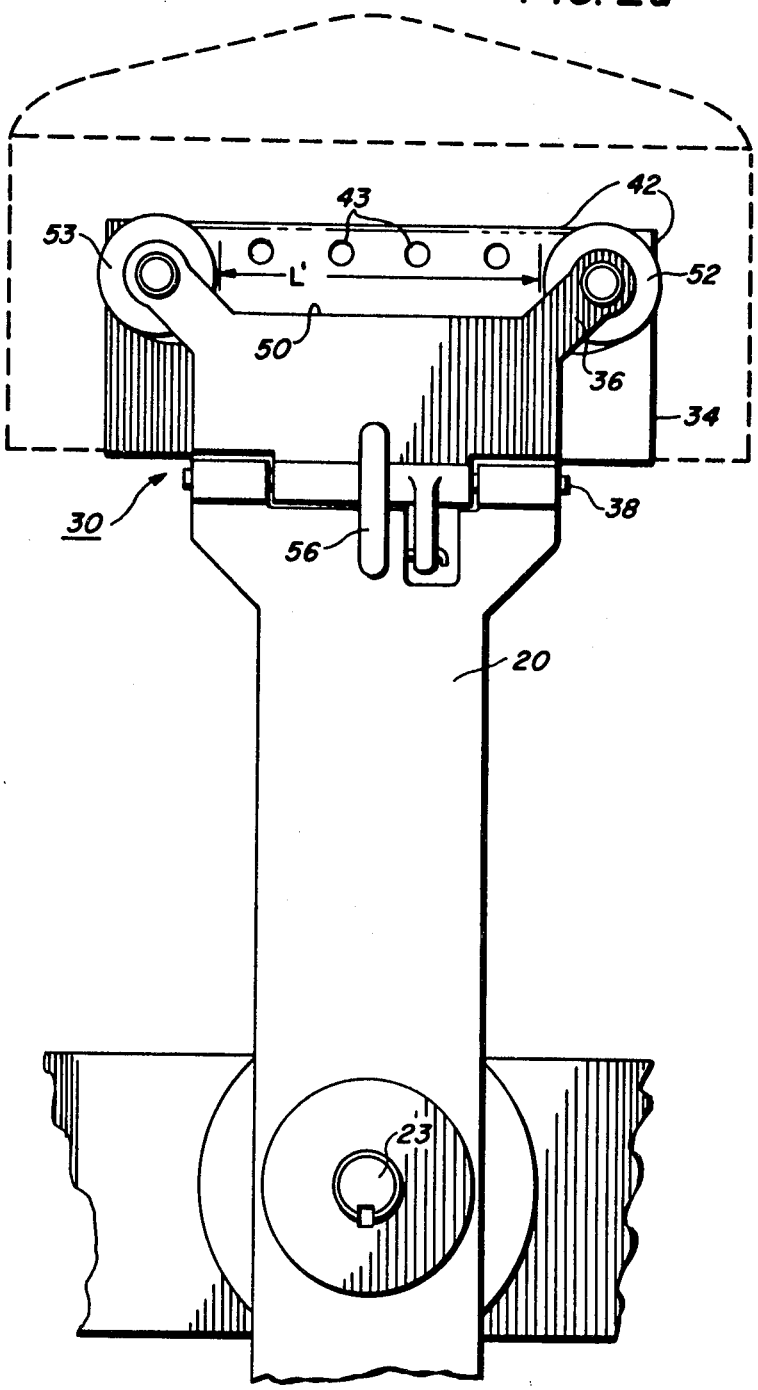
Figure 2B:
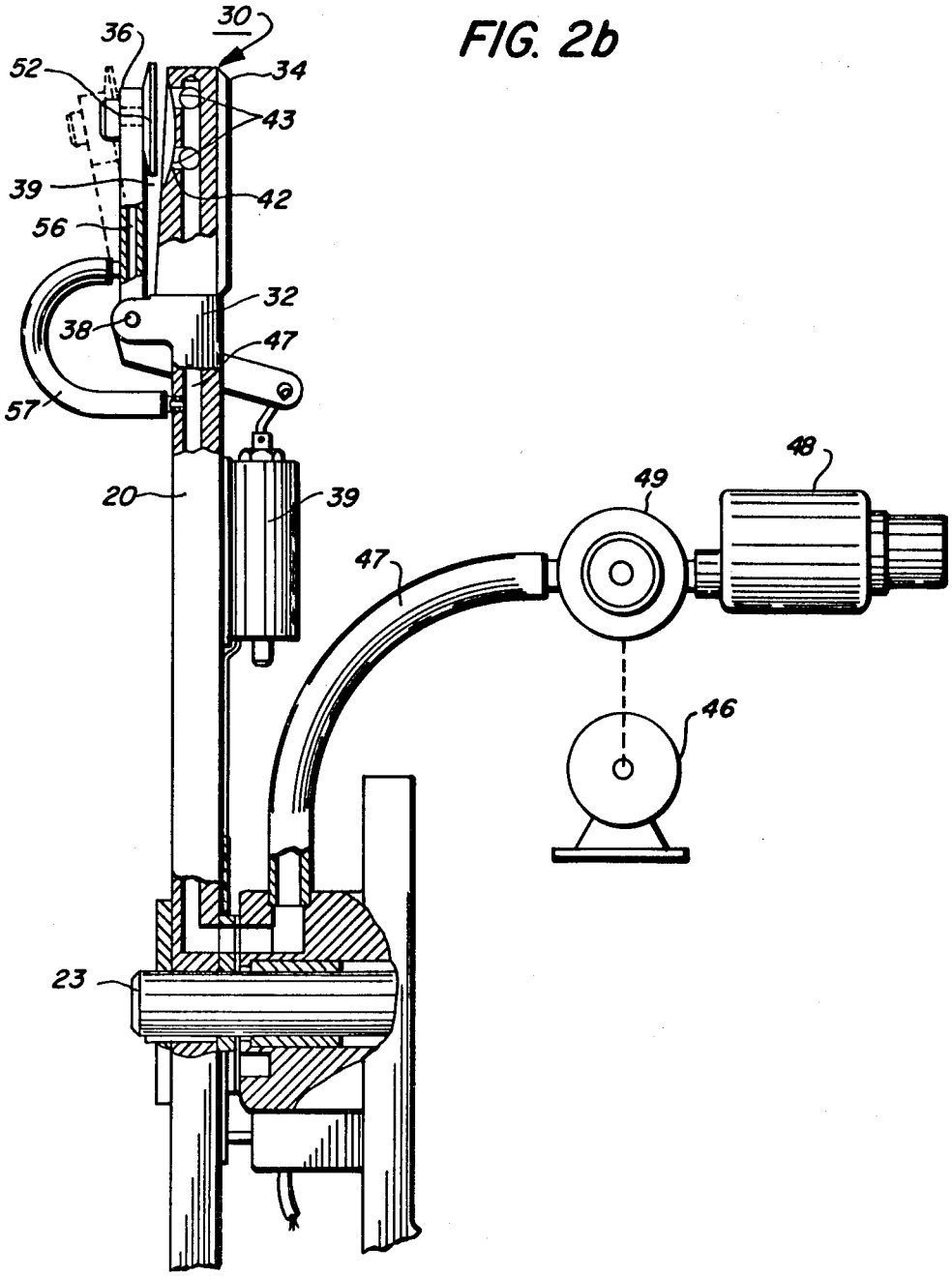
Figure 3A:
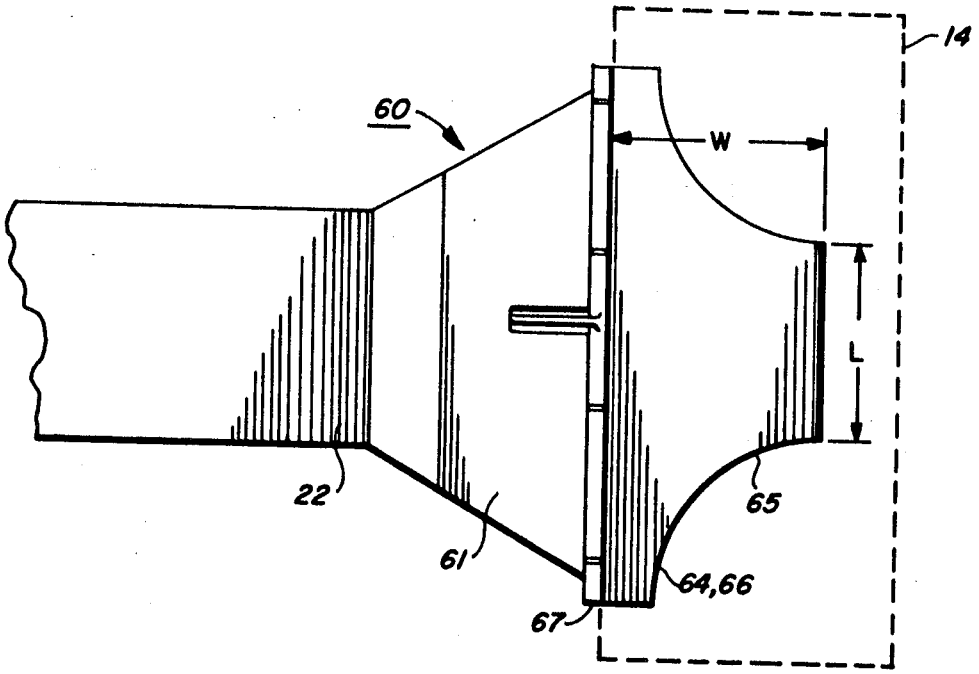
Figure 3B:
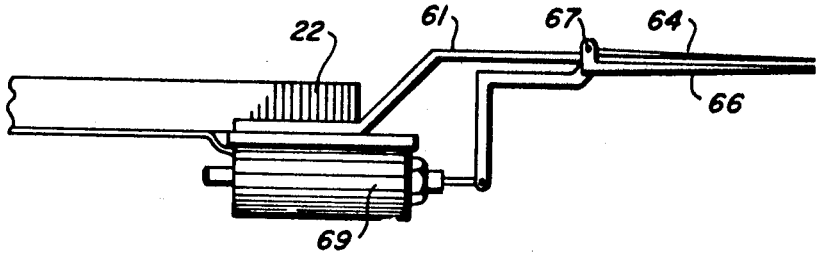

Referring to FIGS. 1–3 of the drawings, there is shown the rotary inserter 10 of the present invention. As will appear inserter 10 serves to insert or place one or more inserts 14 into envelopes 12. For this purpose, inserter 10 includes an envelope loading station 13 whereat envelopes 12 are provided and an insert loading station 15 whereat inserts 14 are provided. Inserter 10 places the individual insert or inserts 14 into individual envelopes 12 at an inserting station 16. The assembled envelope and insert is thereafter deposited onto discharge conveyor 17 at unloading station 18 for transporting to another processing station, as for example a labelling station where address labels are applied to the envelopes.

As will be understood, inserts 14 may consist of any sheet-like material, such as cards, return envelopes, letters, advertisements, brochures, and the like which are to be inserted into envelopes 12 preparatory to mailing. Envelopes 12, while illustrated herein as common business type envelopes, may comprise any suitable envelope type.

Inserter 10 has a suitable base or frame 19 upon which a pair of rotary coplanar arm-like members 20, 22 are mounted through rotatable drive shafts 23. In a preferred construction, the rotational axis of shafts 23 are centered in members 20, 22. Suitable driving means for rotating shafts 23 and the members 20, 22 attached thereto is provided which in the example shown, comprises a motor 28 coupled to shafts 23 through gear set 24. Gear set 24 and motor 28 are chosen to rotate members 20, 22 in opposite directions at the same rotational speed.

Referring particularly to FIGS. 2*a* and 2*b*, support member 20 has envelope clamps 30 attached to opposite ends thereof. Each envelope clamp 30 includes a suitable base 32 fixedly attached to member 20 adjacent the end thereof by suitable means (not shown). A pair of opposing clamp jaws 34, 36 are mounted on base 32, jaws 34, 36 extending in a radially outward direction.

Clamp jaws 34, 36 each preferably comprise a plate-like element, with jaw 34 being fixedly attached to clamp base 32. Clamp jaw 36 is pivotally attached to base 32 adjacent the lower edge of jaw 36 as by means of pivot pin 38. Solenoid 39 serves when energized to open clamp jaw 36, the internal solenoid armature spring (not shown) serving to bias jaw 34 in a clamp closing direction.

Clamp jaw 34 is generally rectangular in shape, the dimensions of jaw 34 being sufficient to accommodate the largest envelope contemplated. The envelope gripping surface 42 of jaw 34 is beveled or sloped downwardly in a radial outward direction to accommodate insert clamp 60 at inserting station 16 as will appear. Vacuum ports 43 in the surface 42 are connected with a suitable vacuum source 46 through vacuum line 47 and vacuum control valve 49. A vacuum control solenoid 48 controls opening and closing of valve 49.

The configuration and dimension of clamping jaw 36 is similar to that of jaw 34, clamping jaw 36 additionally having a generally V-shaped cutout of notch 50 in the upper edge thereof. A pair of spaced vacuum cups 52, 53 are provided in the surface of clamp jaw 36. Vacuum cups 52, 53 are coupled to vacuum control valve 49 through interconnecting vacuum lines 56, 57 and 47.

Referring particularly to FIGS. *3a* and *3b*, support member 22 has an insert clamp 60 attached to the opposite ends thereof. Insert clamps 60 are generally similar in construction to envelope clamp 30, insert clamp 60 having a base 61 fixedly attached by suitable means (not shown) to member 22. A pair of opposing clamp jaws 64, 66 are provided, jaw 64 being fixedly secured to base 61 while jaw 66 is pivotally attached to base 61 by pivot pin 67. Solenoid 69 serves when energized to open jaw 66, the internal solenoid armature spring (not shown) serving to bias jaw 66 in a clamp closing direction.

Insert clamp jaws 64, 66 are generally rectangular in shape, with an arcuate cutout portion 65 at the ends thereof. The longitudinal dimension (L) of jaws 64, 66 adjacent the outer end thereof is less than the dimension L' between vacuum cups 52, 53 of envelope clamp 30. This enables clamp 60 to effectively grasp the insert 14 while permitting the insert clamp jaws 64, 66 to enter within the confines of envelope clamp jaws 34, 36 at inserting station 16. The width dimension (W) of jaw 64 is less than the width of insert 14 to assure that the insert 14 held by clamp 60 projects above the clamp surface. Preferably, the width of jaw 66 is about three-fourths the width of insert 14.

The arc of movement of members 20, 22 and clamps 30, 60 mounted thereon is such that insert clamp jaw 64 moves in a path slightly above the path of movement of envelope clamp jaw 34 while insert clamp jaw 66 moves in a path below envelope clamp jaw 36 as clamps 30, 60 pass through inserting station 16. As a result, the outer portion of insert clamp 60 enters envelope clamp 30 (envelope clamp 30 is open at this point) to place the insert 14 into the envelope carried by clamp 30. The particular configuration of envelope clamp jaw 36 and of insert clamp jaws 64, 66 obviate interference between clamps 30, 60. Additionally, insert clamp jaws 64, 66 are formed from relatively thin sheet metal to further reduce the chance of interference.

Figure 4:
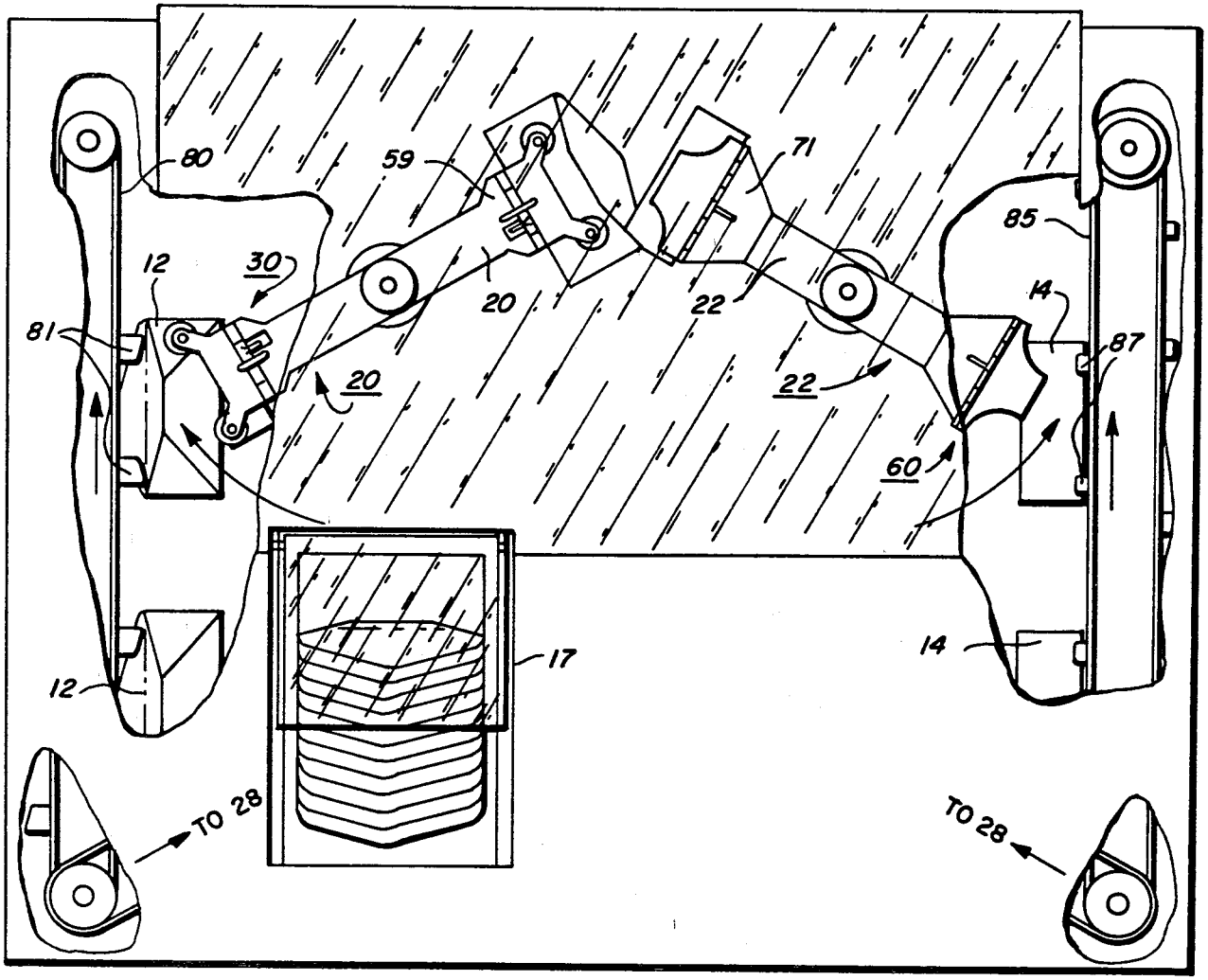
FIG. 4 is a schematic view showing details of the envelope and insert supply means.

Referring particularly to FIG. 4, envelopes 12 are supplied to inserter 10 at envelope loading station 13 from a suitable source (not shown) by means of endless conveyor 80. Conveyor 80 includes envelope gripping devices 81 for releasably attaching the envelopes 12 to be processed to conveyor 80, gripping devices 81 being arranged to hold the envelopes 12 in an inverted upright position. As will be understood, this permits the envelope clamp 30 to grasp the lower portion of the envelope as envelope clamp 30 comes into operative relationship with the envelope conveyor 80. Envelope conveyor 80 is driven by motor 28 and synchronized to clamp tangential speed.

In a similar manner, inserts 14 are supplied to inserter 10 at insert loading station 15 from a suitable source (not shown) by means of an endless conveyor 85 having spaced insert gripping devices 87 disposed therealong. Insert gripping devices 87 hold inserts 14 upright and as conveyor 85 brings the inserts forward to insert loading station 15, the insert is grasped and removed from conveyor 85 by insert clamp 60. In order to assure that the printed material on the insert is correctly oriented in the envelopes 12, inserts 14 are supplied to insert loading station 15 in inverted form. Insert conveyor 85 is driven by motor 89 and synchronized to clamp tangential speed.

Figure 5:
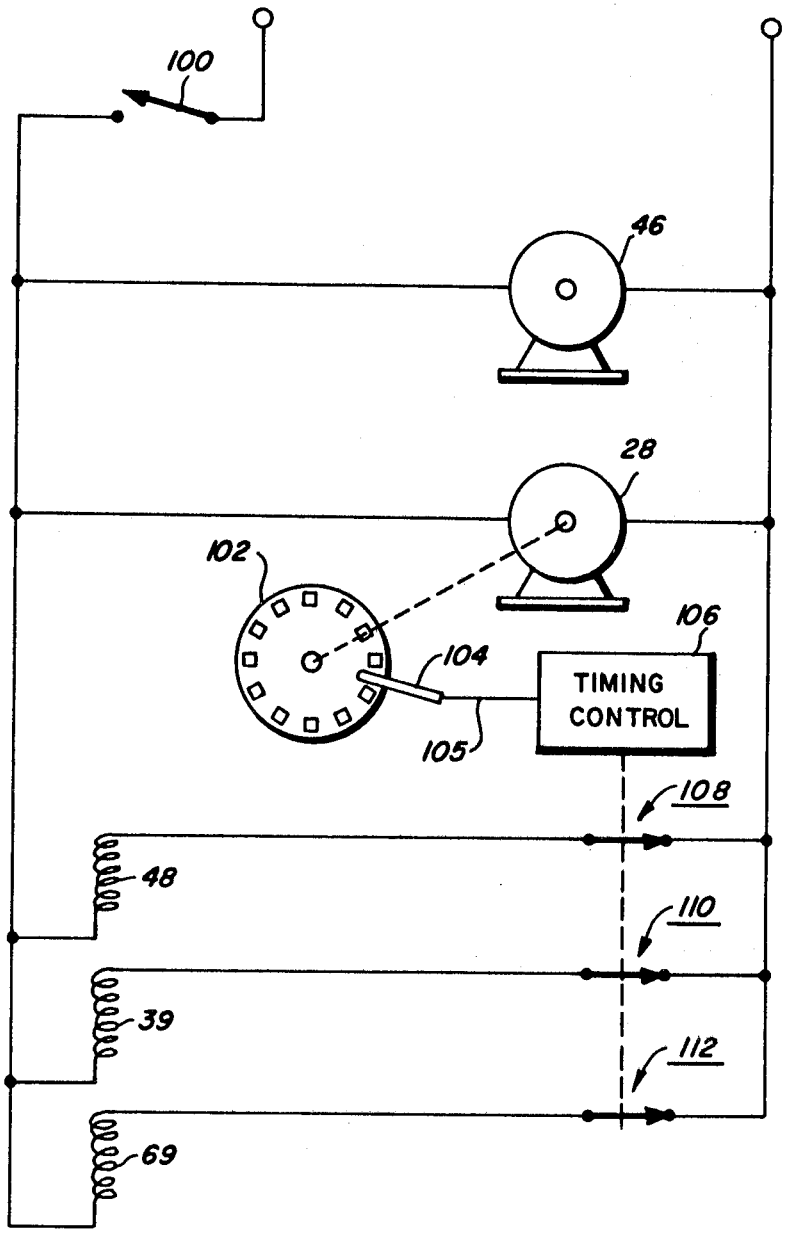
FIG. 5 is a circuit schematic of the inserter controller.

Referring particularly to FIG. 5, a master control switch 100 is provided for initiating operation of inserter 10 together with envelope and insert supply conveyors 80, 85 respectively, closure of switch 100 completing an energizing circuit to inserter drive motor 28, and vacuum source 46.

A suitable speed transducer such as timing disc 102 attached to the shaft of motor 28, and photocell type pickup 104 is provided to generate timing pulses corresponding to the rotational speed of inserter drive motor 28. Timing pulses generated by photocell 104 are input via line 105 to timing controller 106. The output of controller 106 controls opening and closing of solenoid control switches 108, 110, 112 for vacuum control valve solenoid 48 and clamp operating solenoids 39, 69 respectively.

Figure 6:
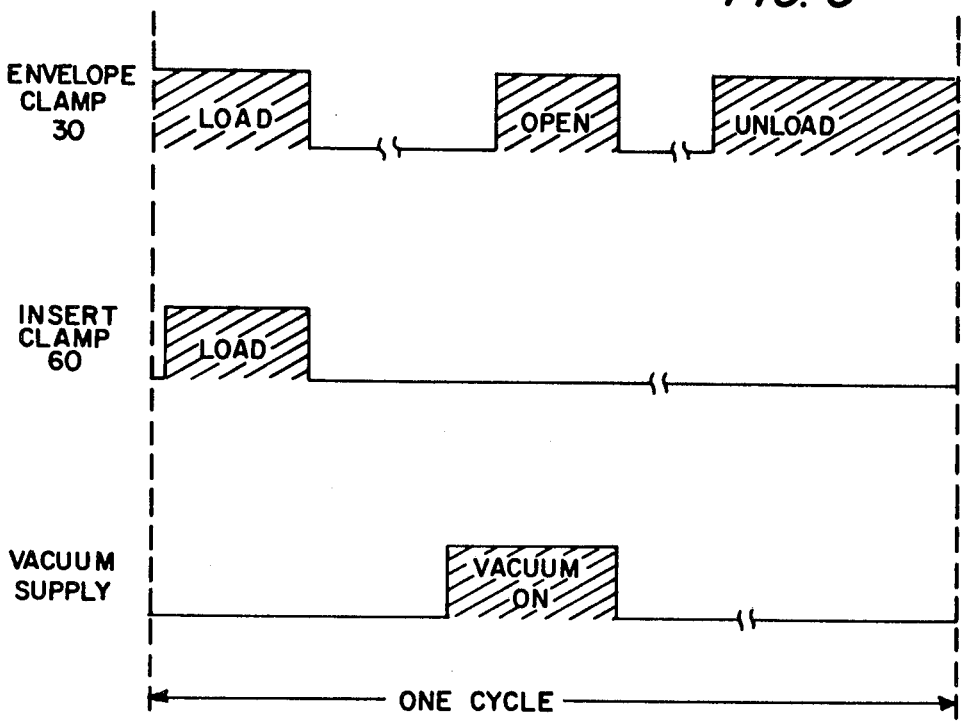
FIG. 6 is a timing chart illustrating the operational sequence of the inserter envelope and insert clamps and vacuum assist over one cycle.

As will be understood, timing controller 106 is preprogrammed to actuate clamp solenoid control switches 110, 112 to energize clamp operating solenoids 39, 69 at predetermined times and for predetermined intervals during rotation of envelope and insert clamps 30, 60. As particularly shown in FIG. 6 of the drawings, clamp operating solenoid 39 is energized to open envelope clamp 30 at inserting station 16 to permit inserting of an insert 14 into the empty envelope 12 and at unloading station 18 to deposit the insert containing envelope onto discharge conveyor 17. Solenoid 39 remains energized to hold clamp 30 opened as the clamp moves to envelope loading station 13 to receive an envelope 12. Following receipt of an envelope, solenoid 39 is deenergized to close clamp 30.

Similarly, timing controller 106 energizes clamp operating solenoid 69 to open the insert clamp 60 at insert loading station 15 to receive an insert 14. At inserting station 16, envelope clamp 30 pulls the insert from the insert clamp and insert clamp 60 is accordingly not opened at that point. Timing controller 106 actuates solenoid control switch 108 to energize vacuum control valve solenoid 48 to admit vacuum to clamp jaws 34, 36 of envelope clamp 30 at inserting station 16.

OPERATION

In operation, and referring particularly to FIGS. 1, 4, 5 and 6 of the drawings, control switch 100 is closed to complete energizing circuits to inserter drive motor 28, and vacuum source 46. Energization of inserter drive motor 28 rotates envelope and insert clamp support members 20, 22 respectively through gear set 24, members 20, 22 rotating in opposite directions. As envelope and insert clamps 30, 60 pass through envelope and insert loading stations 13, 15 respectively, timing controller 106 actuates clamp control switch 112 to energize solenoid 69 and open insert clamp 60. Envelope clamp 30 is previously opened at unloading station 18 as described above.

In timed unison with the passage of envelope and insert clamps 30, 60 through envelope and insert loading stations 13, 15, envelope and insert conveyors 80, 85 bring forward the next successive envelope 12 and insert 14. As the envelope and insert on conveyors 80, 85 pass through envelope and insert and loading stations 13, 15, the envelope and insert are interposed into the jaws of clamps 30, 60. Thereafter, the envelope and insert conveyor gripping devices 81, 87 are released while solenoids 39, 69 are deenergized. Deenergization of solenoids 39, 69 closes envelope and insert clamp jaws 34, 36 and 64, 66 to cause clamps 30, 60 to clamp the respective envelope and insert and transfer the same from conveyors 80, 85 to envelope and insert clamps 30, 60.

As the envelope and insert now held by clamps 30, 60 are carried around in an arc toward inserting station 16, a signal from timing controller 106 closes control switch 108 to energize solenoid 48. Energization of solenoid 48 opens vacuum control valve 49 to communicate via vacuum lines 47, 56, 57, vacuum ports 43 and vacuum cups 52, 53 with the vacuum source 46. The admission of vacuum to ports 43, and vacuum cups 52, 53 causes the sides of envelope 12 held by envelope clamp 30 to be drawn toward the interior walls of clamp jaws 34, 36. A signal from timing controller 106 actuates envelope clamp control switch 110 to open envelope clamp 30. Due to the vacuum attachment of the envelope sides to the clamp jaws, opening of clamp jaws 34, 36 spreads the envelope 12 apart in preparation for receipt of the insert 14.

As envelope 12 and insert 14 pass through inserting station 16, the overlapping trajectories of envelope 12 and insert 14 and the outer peripheries of envelope and insert clamps 30, 60 cause the insert to be placed inside the now opened envelope. With disposition of the insert 14 inside envelope 12, a signal from timing controller 106 deactuates envelope clamp control switch 110 to deenergize envelope clamp solenoid 39 closing envelope clamp 30. As envelope clamp 30 closes, the insert or inserts held by insert clamp 60 is pulled therefrom. The envelope with the insert or inserts therewithin is now held by envelope clamp 30.

Timing controller 106 thereafter deenergizes solenoid 48 to close vacuum control valve 49 and terminate the admission of vacuum to ports 43, 52, 53 of envelope clamp 30. As the envelope clamp 30 carrying the envelope and one or more inserts therein passes through unloading station 18, timing controller 106 closes envelope control switch 110 to energize envelope clamp solenoid 39 to open clamp 30. This releases the envelope with the insert or inserts therewithin onto discharge conveyor 17.

The foregoing process is repeated for subsequent envelopes and inserts.

While envelope and insert clamps 30, 60 respectively and vacuum control valve 49 have been illustrated and described herein as being solenoid operated, other operating mechanisms such as cam and follower may be readily envisioned. For example, one or more suitably configured cam tracks may be provided at optimum locations along the path of movement of envelope and insert clamps 30, 60 to coact with cam follower elements associated with clamps 30, 60 to selectively open and close clamps 30, 60 and admit vacuum at appropriate times during the rotational cycle thereof.

While envelope and insert clamp pairs 30, 60 are illustrated and described herein, it will be understood that a single envelope and insert clamp may be provided on members 20, 22. In that event, suitable counterbalance weights would preferably be provided at the opposite ends of members 20, 22 to counterbalance the weight of clamps 30, 60. Alternately, additional pairs of clamp support members may be provided, as for example, a second pair of members 20, 22 at right angles to the members 20, 22 respectively illustrated and described herein. With envelope and insert clamps mounted on each end of the additional clamp support members, a total of four envelope and insert clamp pairs would then be provided to enhance the throughput capabilities of inserter 10.

While the invention has been described with reference to the structure disclosed, it is not confined to the details set forth, but is intended to cover such modifications or changes as may come within the scope of the following claims.

I claim:

1. An inserter comprising;

a pair of rotatable support members;

envelop clamping means on one of said support members adjacent a periphery thereof;

insert clamping means on the other of said support members adjacent a periphery thereof;

means supporting said members for rotation such that said envelope clamping means and said insert clamping means overlap one another during a portion of the arc of rotation of said members in an insert area;

means to supply an envelope to said envelope clamping means at a point in the rotational arc of the member supporting said envelope clamping means remote from said insert area;

means to supply at least one insert to said insert clamping means at a point in the rotational arc of the member supporting said insert clamping means remote from said insert area;

means for actuating said envelope clamping means and said insert clamping means to grasp the envelope and insert provided thereto;

means for rotating said members in opposite directions so that said envelope and insert clamping means bring said envelope and insert into overlapping relation as said envelope and insert clamping means pass through said insert area;

envelope spreading means to spread said envelope for receipt of said insert upstream of said insert area;

said insert and said envelope having substantially planar configurations prior to spreading of said envelope and being in substantially coplanar relationship with one another and substantially parallel with the planes of the rotational arcs of the clamping means on the support members while in the insert area;

means to transfer said insert from said insert clamp means following disposition of said insert in said envelope;

means to inactivate said envelope spreading means to enable said envelope to close; and means to release said envelope clamping means and discharge said envelope together with said insert.

2. An inserter comprising;

a pair of rotatable support members;

envelope clamping means on one of said support members adjacent a periphery thereof;

insert clamping means on the other of said support members adjacent a periphery thereof;

means supporting said members for rotation such that said envelope clamping means and said insert clamping means overlap one another during a portion of the arc of rotation of said members in an insert area;

means to supply an envelope to said envelope clamping means at a point in the rotational arc of the member supporting said envelope clamping means remote from said insert area;

means to supply at least one insert to said insert clamping means at a point in the rotational arc of the member supporting said insert clamping means remote from said insert area;

means for actuating said envelope clamping means and said insert clamping means to grasp the envelope and insert provided thereto;

means for rotating said members in opposite directions so that said envelope and insert clamping means bring said envelope and insert into overlapping relation as said envelope and insert clamping means pass through said insert area;

envelope spreading means to spread said envelope for receipt of said insert upstream of said insert area;

said insert and said envelope having substantially planar configurations prior to spreading of said envelope and being in substantially coplanar relationship with one another and substantially parallel with the planes of the rotational arcs of the clamping means on the support members while in the insert area;

said envelope spreading means comprising vacuum suction means for grasping opposing sides of said envelope to spread said envelope for receipt of said insert;

means to transfer said insert from said insert clamping means following disposition of said insert in said envelope;

means to inactivate said vacuum suction means to enable said envelope to close; and means to release said envelope clamping means and discharge said envelope together with said insert.

3. An inserter comprising;

a pair of rotatable support members;

envelope clamping means on one of said support members adjacent a periphery thereof;

insert clamping means on the other of said support members adjacent a periphery thereof;

means supporting said members for rotation such that said envelope clamping means and said insert clamping means overlap one another during a portion of the arc of rotation of said members in an insert area;

means to supply an envelope to said envelope clamping means at a point in the rotational arc of the member supporting said envelope clamping means remote from said insert area;

means to supply at least one insert to said insert clamping means at a point in the rotational arc of the member supporting said insert clamping means remote from said insert area;

means for actuating said envelope clamping means and said insert clamping means to grasp the envelope and insert provided thereto;

said means for actuating said envelope and insert clamping means comprising a solenoid;

means for rotating said members in opposite directions so that said envelope and insert clamping means bring said envelope and insert into overlapping relation as said envelope and insert clamping means pass through said insert area;

envelope spreading means to spread said envelope for receipt of said insert upstream of said insert area;

said insert and said envelope having substantially planar configurations prior to spreading of said envelope and being in substantially coplanar relationship with one another and substantially parallel with the planes of the rotational arcs of the clamping means on the support members while in the insert area;

means to transfer said insert from said insert clamping means following disposition of said insert in said envelope;

means to inactivate said envelope spreading means to enable said envelope to close; and means to release said envelope clamping means and discharge said envelope together with said insert.

4. An inserter comprising;

a pair or rotatable support members;

envelope clamping means on one of said support members adjacent a periphery thereof;

said envelope clamping means comprising first and second clamping elements; and means supporting at least one of said first and second clamping elements for movement into clamping engagement with the other of said first and second clamping elements;

insert clamping means on the other of said support members adjacent a periphery thereof;

means supporting said members for rotation such that said envelope clamping means and said insert clamping means overlap one another during a portion of the arc of rotation of said members in an insert area;

means to supply an envelope to said envelope clamping means at a point in the rotational arc of the member supporting said envelope clamping means remote from said insert area;

means to supply at least one insert to said insert clamping means at a point in the rotational arc of the member supporting said insert clamping means remote from said insert area;

means for actuating said envelope clamping means and said insert clamping means to grasp the envelope and insert provided thereto;

means for rotating said members in opposite directions so that said envelope and insert clamping means bring said envelope and insert into overlapping relation as said envelope and insert clamping means pass through said insert area;

envelope spreading means to spread said envelope for receipt of said insert upstream of said insert area;

said insert and said envelope having substantially planar configurations prior to spreading of said envelope and being in substantially coplanar relationship with one another and substantially parallel with the planes of the rotational arcs of the clamping means on the support members while in the insert area;

said envelope spreading means including at least one vacuum port on each of said first and second clamping elements;

means to transfer said insert from said insert clamping means following disposition of said insert in said envelope;

means to inactivate said envelope spreading means to enable said envelope to close; and means to release said envelope clamping means and discharge said envelope together with said insert.

5. An inserter comprising;

a pair of rotatable support members;

envelope clamping means on one of said support members adjacent a periphery thereof;

said envelope clamping means including a pair of relatively movable insert clamp jaws for grasping envelopes, insert clamping means on the other of said support members adjacent a periphery thereof;

said insert clamping means including a pair of relatively movable envelope clamp jaws for grasping inserts, means supporting said members for rotation such that said envelope clamping means and said insert clamping means overlap one another during a portion of the arc of rotation of said members in an insert area;

the rotational path of said envelope and insert clamp jaws being such that said insert clamp jaws pass within the confines of said envelope clamp jaws at said insert area;

means to supply an envelope to said envelope clamping means at a point in the rotational arc of the member supporting said envelope clamping means remote from said insert area;

means to supply at least one insert to said insert clamping means at a point in the rotational arc of the member supporting said insert clamping means remote from said insert area;

means for actuating said envelope clamping means and said insert clamping means to grasp the envelope and insert provided thereto;

means for rotating said members in opposite directions so that said envelope and insert clamping means bring said envelope and insert into overlapping relation as said envelope and insert clamping means pass through said insert area;

envelope spreading means to spread said envelope for receipt of said insert upstream of said insert area;

said insert and said envelope having substantially planar configurations prior to spreading of said envelope and being in substantially coplanar relationship with one another and substantially parallel with the planes of the rotational arcs of the clamping means on the support members while in the insert area;

means to transfer said insert from said insert clamping means following disposition of said insert in said envelope;

means to inactivate said envelope spreading means to enable said envelope to close; and means to release said envelope clamping means and discharge said envelope together with said insert.

6. The inserter according to claim 5 in which one of said envelope clamp jaws is beveled outwardly to facilitate insertion of said insert clamp jaws within said envelope clamp jaws.

7. The method of placing a planar insert into a planar envelope in a uniform non-reciprocatory motion and without substantial vibration, the steps which comprise:

(a) grasping an envelope;

(b) grasping an insert to be inserted into the envelope;

(c) moving said envelope and insert along separate but converging rotary paths so that said envelope and insert are momentarily in a common plane substantially containing the planar bodies of said envelope and said insert with said common plane being parallel with the planes of the rotary paths;

(d) as said envelope and said insert near each other, spreading said envelope apart to permit insertion of said insert;

(e) while said envelope and said insert are in said common plane, inserting said insert into said envelope ; and (f) before said paths re-converge, releasing said envelope with said insert therewithin before grasping the next envelope and insert.

* * * * *